United States Patent [19]

DeRuiter et al.

[11] Patent Number: 4,978,826

[45] Date of Patent: Dec. 18, 1990

[54] HIGH FREQUENCY OVEN WITH PLURAL HEATING LEVELS AND AN IMPROVED EFFICIENCY OF POWER TRANSFER

[75] Inventors: J. W. DeRuiter, Eindhoven; Lucas A. Butot, Amsterdam, both of Netherlands

[73] Assignee: Super M Associates, Westport, Conn.

[21] Appl. No.: 207,561

[22] Filed: Jun. 16, 1988

Related U.S. Application Data

[63] Continuation-in-part of Ser. No. 24,064, Mar. 10, 1987, Pat. No. 4,812,609.

[51] Int. Cl.[5] ..... H05B 6/54

[52] U.S. Cl. ..... 219/10.81; 219/10.75; 219/10.77; 219/10.67; 99/451; 99/358

[58] Field of Search ..... 219/10.81, 10.75, 10.77, 219/10.71, 10.67; 99/451, 358, DIG. 14; 426/234

[56] References Cited

U.S. PATENT DOCUMENTS

| | | | |
|---|---|---|---|
| 2,401,277 | 5/1946 | Stratton | 219/10.81 |
| 2,567,983 | 9/1951 | Wood | 219/10.81 |
| 2,765,388 | 10/1956 | Moore | 219/10.81 |
| 4,119,826 | 10/1978 | Chambley et al. | 219/10.81 |
| 4,205,210 | 5/1980 | Salway-Waller et al. | 219/10.81 |
| 4,296,298 | 10/1981 | MacMaster et al. | 219/10.81 |
| 4,531,038 | 7/1985 | Lillibridge et al. | 219/10.81 |
| 4,567,340 | 1/1986 | Latchum, Jr. | 219/10.77 X |
| 4,812,609 | 3/1989 | Butot | 219/10.81 |

*Primary Examiner*—Philip H. Leung

*Attorney, Agent, or Firm*—Lowe, Price, LeBlanc, Becker & Shur

[57] ABSTRACT

A high-frequency dielectric oven uses a plurality of oscillating circuits, which are caused to operate in a predetermined phase relationship, to produce a higher voltage distribution within a load capacitor, thus permitting an increase in the space between the electrode plates of the load capacitor to enable use of the oven for heating commercial quantitites of foodstuff. The generated electric field has a distribution which minimizes the number of nodes of a standing wave, thus reducing the occurrences of cold spots in the heating cavity. A plurality of tray levels are provided, each level having a separate pair of electrodes generating the electric field therefor. The electrodes may be shaped to provide direct support for the trays. Power transferred to the foodstuff is controlled by a variable air gap capacitor and the power tube operates at a substantially constant power level, irrespective of the power being transferred to the foodstuff.

30 Claims, 6 Drawing Sheets

39
L2
26
2
4
139
C2
149
C4
124
C5
CAPACITOR PLATE
36
C8
LOAD
OVEN CASE
137
147
C3
b
150
a
3
FEEDBACK
24
37
L1
C7
C8
TUBE
L3
L4
R
C9
C10
+
-
158
152
CAPACITIVE VOLTAGE DIVIDER
CAPACITOR PLATE
FICTIVE EARTH
WATER
FOOD
OVEN CASE
156
VARIABLE AIR GAP

HIGH FREQUENCY OVEN WITH PLURAL HEATING LEVELS AND AN IMPROVED EFFICIENCY OF POWER TRANSFER

This is a continuation-in-part of application Ser. No. 024,064, filed Mar. 10, 1987, by the applicant hereof, for Device of Heating a Device by Means of Dielectric High Frequency Heating now U.S. Pat. No. 4,812,609.

TECHNICAL FIELD

This invention relates to an improved device for heating a product, and particularly for heating foodstuff, by dielectric high frequency heating utilizing a power tube and an oscillating circuit, and particularly to improvements in such a device providing for increased power transfer to the foodstuff without requiring increased power and voltage ratings for the power tube and, still further, to such devices including multiple support levels therein for heating commercial quantities of food.

BACKGROUND ART

Prior art devices for heating and cooking of foodstuff are known. However, such devices are typically limited in the volume of the foodstuff which may be heated or cooked thereby, thus precluding commercial applications of such prior art devices. Prior art commercial ovens, which have rack guided tracks for stackability of a large number of pans, are thus convection ovens, wherein a slow convection heating process is utilized.

Moreover, the known prior art devices utilize oscillating circuits requiring power tubes which are specially designed therefor. The prior art oscillating circuits generally provide a substantially fixed distribution of voltage and power within the heating cavity. Thus, longer heating or cooking times are required for heating or cooking greater volumes of foodstuff. Further, the prior art devices operate at frequencies which are strongly dependent on the characteristics of the foodstuff being cooked.

Additionally, while prior art high frequency cooking cavities are known to include a vertical stacking facility, thus permitting heating of multiple levels of food within a single cavity, only a single pair of electrodes is provided for transferring the electromagnetic energy to the heating (or cooking) cavity. Thus, when use is made of the different numbers of available cooking levels, the quantity of energy delivered to each food product is reduced and longer heating or cooking times are required.

There is thus a need in the prior art for high frequency dielectric heating devices capable of heating and cooking commercial quantities of foodstuff. There is more particularly a need in the prior art for high frequency heating devices capable of heating large quantities of foodstuff without experiencing a resultant lengthening in the necessary heating time. There is a specific need in the prior art for multilevel cooking structures to facilitate performance of such operations, wherein the use of such plural levels for the heating of foodstuff does not result in a reduction in the quantities of energy delivered per unit time to the various foodstuffs being cooked.

There is a further need in the prior art to provide a high frequency, dielectric heating apparatus, having an increased efficiency of energy transfer between the power tube of the oscillating circuit and the foodstuff, where dielectric losses generate a desired heat level.

DISCLOSURE OF INVENTION

It is accordingly an object of the present invention to overcome the deficiencies of the prior art and to provide a high frequency dielectric oven for more efficient heating of large quantities of foodstuff.

It is a more particular object of the invention to provide an improved dielectric oven including structure for increasing the power transferred from an oscillating circuit used in the oven to the foodstuff heated thereby, without increasing the operating voltage of, or power dissipated by, a power tube in the circuit, and without changing the required frequency of operation thereof.

It is still another object of the invention to provide an increase in the power transferred from an oscillating circuit of a high-frequency dielectric oven to the foodstuff heated thereby by utilizing a plurality of oscillating circuits, each circuit receiving power from the power tube, and further to provide an arrangement for establishing a desired phase relationship between signals in pairs of the oscillating circuit, thus to yield the increased power transfer.

Yet another object of the invention is the provision of a plurality of separate load electrodes for the foodstuff, the electrodes connected between different oscillating .circuits, thus minimizing the effect of different dielectric characteristics of the foodstuff on the frequencies of the oscillating circuits.

It is still a further object of the invention to double the voltage developed across foodstuff, included within a load capacitor in a heating cavity of a high frequency dielectric oven, by providing a pair of oscillating circuits having substantially identical resonant frequencies and by establishing a 180° phase differential between the signals of the circuits applied to the plates of the load capacitor.

It is an alternate object of the invention to double the distance between the plates of a load capacitor, relative to a typical heating oven, without decreasing the field intensity therebetween by using a particular oscillating circuit to double the voltage difference between the plates.

An additional object of the invention is to establish the electrodes of the pair of oscillating circuits to radiate an open electromagnetic field therebetween, while connecting electrodes from different oscillating circuits as plates of a load capacitor, radiating an open electromagnetic field through the foodstuff at a power intensity determined by the dielectric characteristics of the foodstuff, thus providing differing energy levels for different foodstuffs while maintaining substantially constant power level operation of the power tube.

It is another object of the invention to provide a variable air gap capacitor for controlling the power applied to the foodstuff within the heating cavity.

Yet another object of the invention is to structure the electrodes of the oscillating circuits as supports for trays containing the foodstuff, wherein an air gap between the electrodes and the trays is provided for controlling the energy delivered to the foodstuff.

It is a further object of the invention to provide a circuit for controlling operation of the power tube of a high frequency dielectric oven by feeding back a control voltage to the grid of the tube, the control voltage taken by a feedback electrode from a capacitive voltage divider, which is provided either within or externally of the cavity.

Still another object of the invention is the provision of a multi-level heating structure in a high frequency dielectric oven, including therein separate pairs of electrodes to form a separate load capacitor for each of a plurality of vertically displaced heating levels within a cavity of the oven.

It is yet a further object of the invention to provide a structural configuration for the plates of load capacitors in a multi-level heating cavity of a high frequency dielectric oven, each load capacitor providing electromagnetic energy to a separate heating level, wherein the capacitor plates provide support for trays containing the foodstuff to be heated, and more particularly wherein the plates of a single capacitor are arranged to support a plurality of sub-levels of trays.

In accordance with the invention, there is provided an improved high-frequency dielectric oven for cooking foodstuffs. Specifically, a power increasing device is provided in addition to the known components of such ovens, which include a cavity for receiving the foodstuff when cooking, a high frequency oscillating circuit, including a power tube, for generating a high frequency electric signal and an electrode arrangement for introducing an electric field into the cavity to transfer power from the oscillating circuit to the foodstuff. The power increasing device is broadly operable for increasing the power transferred from the oscillating circuit to the foodstuff, without increasing the operating voltage of the tube or the frequency of operation thereof.

In accordance with one aspect of the invention, the foodstuff is positioned between plates of a capacitor in the oscillating circuit. The oscillating circuit is arranged to provide a voltage across the capacitor which is twice the voltage across the power tube, thus to permit doubling the distance between the plates of the capacitor without diminution of the field strength therebetween, and to increase the quantities of food which may be heated between the capacitor plates.

In accordance with a specific feature of the invention, the power increasing device includes a plurality of oscillating circuits having substantially identical resonant frequencies. The oscillating circuits receive power from the power tube to establish respective oscillating signals therein. A phase setting structure is connected to the oscillating circuits for establishing a predetermined phase relationship between pairs of the oscillating signals. More particularly, there are provided at least first and second oscillating circuits, and the electrode arrangement includes at least first and second electrodes which are respectively connected to the two oscillating circuits. The first and second electrodes are located in the cavity and include the foodstuff therebetween.

Preferably, the electrode arrangement includes at least first and second electrode pairs within the cavity for including the foodstuff therebetween. Each oscillating circuit has two electrodes, and each electrode pair has first and second electrodes, which are respectively connected to the first and second oscillating circuits. The phase setting structure includes a phase reversing configuration for establishing a 180° phase shift between oscillating signals in the first and second oscillating circuits. Thus, the phase setting structure is operable for doubling a peak value of an oscillating signal voltage applied across each electrode pair, relative to a peak value of a signal voltage applied thereto by a single oscillating circuit.

In this structure, the phase reversing configuration includes a connector between a first electrode of the first electrode pair and a second electrode of the second electrode pair, thereby establishing voltages on the two electrodes of the first electrode pair which are 180° out of phase with one another. Moreover, the connector further establishes a similar relationship between the voltages on the first and second electrodes of the second electrode pair. Indeed, the connector provides the only connection between one of the two oscillating circuits and the power tube.

Each of the oscillating circuits includes an inductance and a capacitance, the capacitance including a pair of capacitors respectively formed between the two electrodes of the oscillating circuit and wall portions of the cavity. Advantageously, the two electrodes of each oscillating circuit are oriented to radiate an open electromagnetic field therebetween. In this arrangement, the electrode pairs form a pair of interconnecting load capacitors between the electrodes of the first and second oscillating circuits. The dielectric of the load capacitors includes the foodstuff placed therein. Such an arrangement thus radiates an open electromagnetic field between the electrodes of each of the pair of interconnecting (load) capacitors. The open electromagnetic field has a power intensity distribution determined by the dielectric characteristic of the foodstuff, while permitting the power tube to operate at a substantially constant power level. Further, the use of the load capacitors as connectors between the two oscillators isolates the frequency of oscillation of the oscillating circuits from the effects of the dielectric characteristics of the foodstuff.

Thus, both the power intensity and the frequency of the power transferring signals are maintained more nearly constant, with reduced variations caused by the dielectric characteristics of the foodstuff being cooked.

A variable air capacitance is included between the electrodes of the interconnecting capacitors and the foodstuff therebetween, for controlling the cooking power applied to the foodstuff within the load capacitors.

The connector between the opposing electrodes of the two electrode pairs, which establishes the 180° phase shift between the signals of the first and second oscillating circuits, thereby establishes a virtual ground plane between the first and second electrodes of each of the load capacitors.

In the inventive structure, a feedback electrode is used for providing a control voltage to a grid of the power tube. The feedback electrode is located between a predetermined electrode of one of the oscillating circuits and one of the wall portions of the cavity, i.e., within one of the capacitors determining the oscillating frequency of the oscillating circuit. The capacitance between the feedback electrode and the grounded wall portion of the cavity, together with the capacitance between the feedback electrode and the electrode of the oscillating circuit, forms a capacitive voltage divider for voltage impressed on the predetermined electrode.

Alternatively, however, the voltage divider may be formed of a pair of separate ceramic capacitors, placed externally of the heating cavity.

In accordance with another facet of the invention, there is provided an improved high-frequency dielectric oven for cooking foodstuff. The improvement includes a multi-level structure within the cavity, for supporting a plurality of vertical levels of foodstuffs therein. Preferably, the multi-level structure includes a separate pair of electrodes, each pair forming a separate load capacitor, for each vertical level in the cavity. Each separate load capacitor, including separate foodstuff between electrode plates thereof, thus separately cooks the foodstuff therebetween. More particularly, the plates of the separate load capacitors radiate separate high-frequency electromagnetic fields for each of the separate vertical levels.

By controlling the power radiated into the foodstuff, the heat generated within the foodstuff as dielectric losses therein is also controlled.

In accordance with a feature of the invention, the electrodes of the oscillating circuits are shaped for supporting a tray containing the foodstuff. Towards that end, each of the electrodes includes a horizontal portion and a depending portion descending at a predetermined angle from the horizontal portion, thereby to provide support thereon for a tray having a horizontal lip and an angularly depending portion connecting the horizontal lip to a bottom portion of the tray. The support configuration may particularly include first and second vertically displaced support structures for each of the capacitor plates. Thus, for each of the separate load capacitors there is provided a pair of vertically displaced cooking levels.

Accordingly, the oven of the invention includes a subdivided multi-level structure, including a plurality of levels. Each of the levels has a separate load capacitor and each has a plurality of sub-levels, formed between the plates of the separate load capacitor thereof.

Other objects, features and advantages of the present invention will become readily apparent to those skilled in the art from the following description wherein there is shown and described a preferred embodiment of the invention, simply by way of illustration and not of limitation of the best mode (and alternative embodiments) for carrying out the invention. The invention itself is set forth in the claims appended hereto. As will be realized upon examination of the specification with due reference to the drawings, the present invention is capable of still other, different, embodiments and its several details are capable of modifications in various obvious aspects, all without departing from the invention which is recited in the claims. Accordingly, the drawings and the descriptions provided herein are to be regarded as illustrative in nature and not as restrictive of the invention.

BRIEF DESCRIPTION OF THE DRAWINGS

The accompanying drawings, incorporated into and forming a part of the specification, illustrate several aspects of the present invention and, together with the description, serve to explain the principles of the invention. In the- drawings.

BEST MODE FOR CARRYING OUT THE INVENTION

Figure 1:
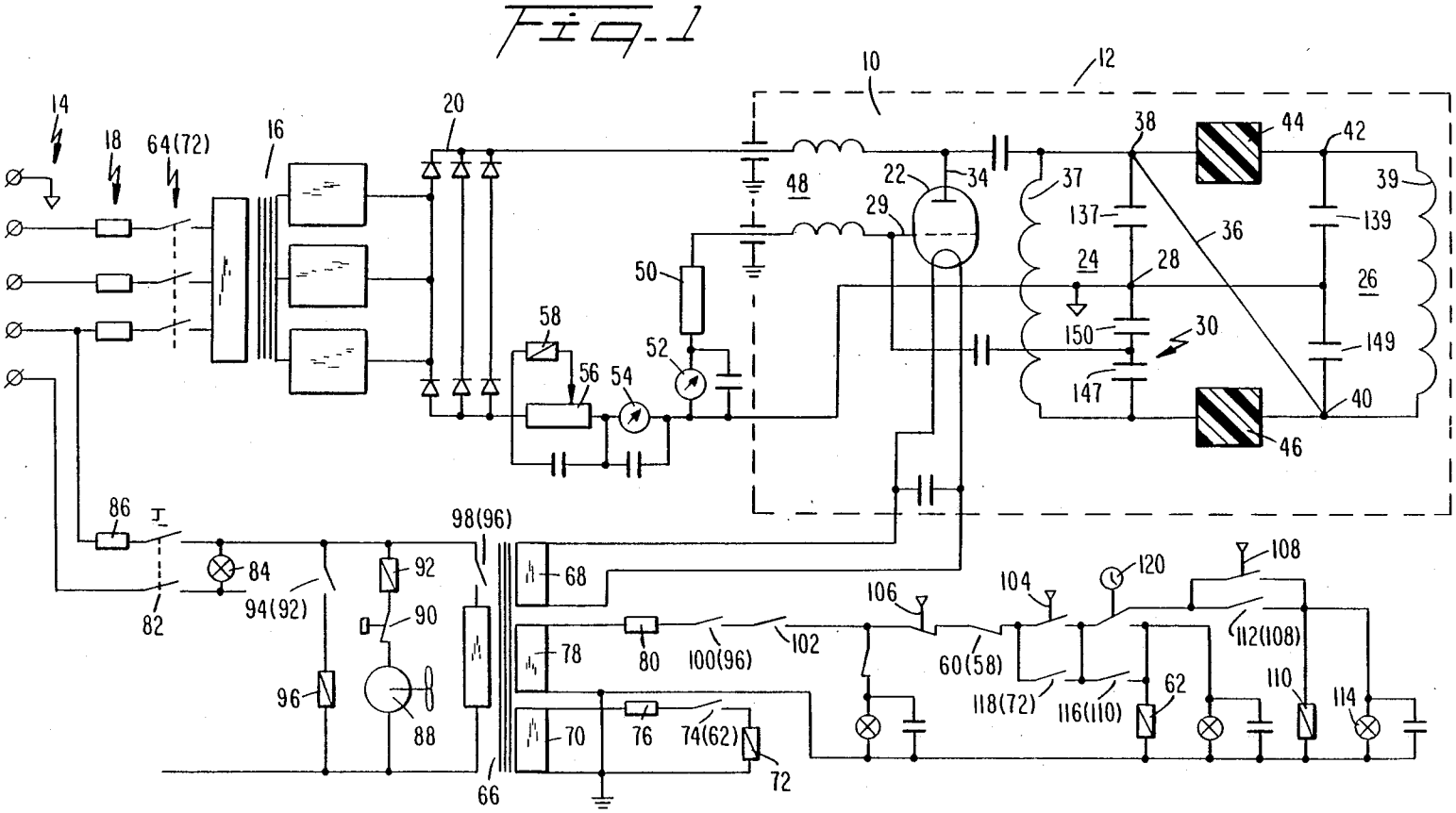
FIG. 1 is a schematic diagram of the electrical circuit of the inventive high-frequency dielectric oven.

The preferred embodiment of the invention is shown in FIG. 1, which is an electrical schematic diagram disclosing interconnection and operation of the electrical circuitry of the invention. As will be appreciated from the following description, the electrical circuit illustrated in FIG. 1 generates a high frequency field for penetrating the foodstuff (or other product) disposed between electrode plates of at least one load capacitor. Although the generated field is an electromagnetic field, because the dimensions of the oven cavity are small in comparison with the wavelength (40 cm compared with 8.6 meters), the magnetic component of the field may be neglected. Accordingly, the following description refers to the energy field as an electric field, rather than an electromagnetic field.

As will be appreciated by those skilled in the art, in a dielectric heating device the high frequency electric field generated by the heating device undergoes dielectric losses within the product, thus causing heating of the same. The product, or foodstuff, being heated may be enclosed in a cooking utensil and/or tray, formed of porcelain, glass, ceramics, polycarbonate materials or the like. While the specific material of the utensil is not significant, such trays, pans and the like are known to be made of non-conducting materials having low dielectric losses.

Referring now to drawing FIG. 1, the high frequency field generating portion of the circuit is generally shown at 10. As is known to those skilled in the art, high frequency signals of the type generated in the generating portion 10 may interfere with external devices. Accordingly, an enclosure 12 (or Faraday cage) is provided, for retaining the radiated high frequency energy within the high frequency oven structure. As is illustrated in the figure, for the commercial embodiments of the improved oven according to the invention a .three-phase power supply is contemplated, as indicated by the plurality of power supply leads shown at 14. A high voltage, three-phase, transformer 16 is provided for converting a 380 volt input voltage to 3 kV output voltage. A plurality of fuses 18 are connected to the primary winding of transformer 16 to provide overload protection for the high voltage transformer.

The high voltage output provided by the secondary winding of transformer 16 is connected to a rectifying bridge, shown at 20, comprising a plurality of diodes arranged in a manner well known to those of ordinary skill in the art. Accordingly, the details of the rectifying bridge are not described herein. It will be appreciated that, although a three-phase alternating current power supply is illustrated, the invention will also operate with other numbers of multiple phases, or with a single phase AC input, upon substitution of an appropriate rectifying bridge for the three-phase rectifying bridge 20. Similarly, if a sufficiently high level DC voltage is available, transformer 16 and rectifying bridge 20 may be eliminated.

Referring now broadly to operation of the high frequency generating portion 10 enclosed within enclosure 12, there is provided a general purpose, communication type, power tube 22, for use in circuit with one or more oscillating circuits. Advantageously, the circuit structure of the present arrangement eliminates a requirement for special purpose tubes used for high frequency generation in heating and cooking devices. Thus, a tube such as type YD 1170, manufactured by Philips, is preferred for use in the present arrangement. Thus, by substitution of a readily available different tube type, the wattage rating of the oven, and the heating capacity thereof, may be easily changed.

A pair of oscillating circuits, shown at 24 and 26, receive current pulses from the power tube 22. It will be appreciated from the subsequent description of operation of the circuits that, while the voltage between and anode and cathode of tube 22 varies between two predetermined voltage levels, thus providing a voltage swing of a predetermined magnitude, each of the oscillating circuits generates an oscillating electrical voltage having twice the predetermined magnitude of the voltage swing across tube 22. Thus, by establishing a phase differential of 180° between voltages at corresponding points of the oscillating circuits 24 and 26, the present invention provides a voltage swing therebetween equal to two times the predetermined magnitude.

By connecting the corresponding points to opposite plates of a load capacitor, between which the foodstuff is placed, the rate of heat transfer to the foodstuff is increased by the increased voltage across the capacitor. Alternatively, the increased voltage difference between the two plates of the load capacitor permits increasing the distance between the capacitor plates, without decreasing the field intensity therebetween. Accordingly, by increasing the space between the plates of the load capacitor the quantity of foodstuff which may be heated by the inventive oven is increased to commercial levels without reducing the field intensity and thus the rate of heat transfer thereto.

Figure 8:
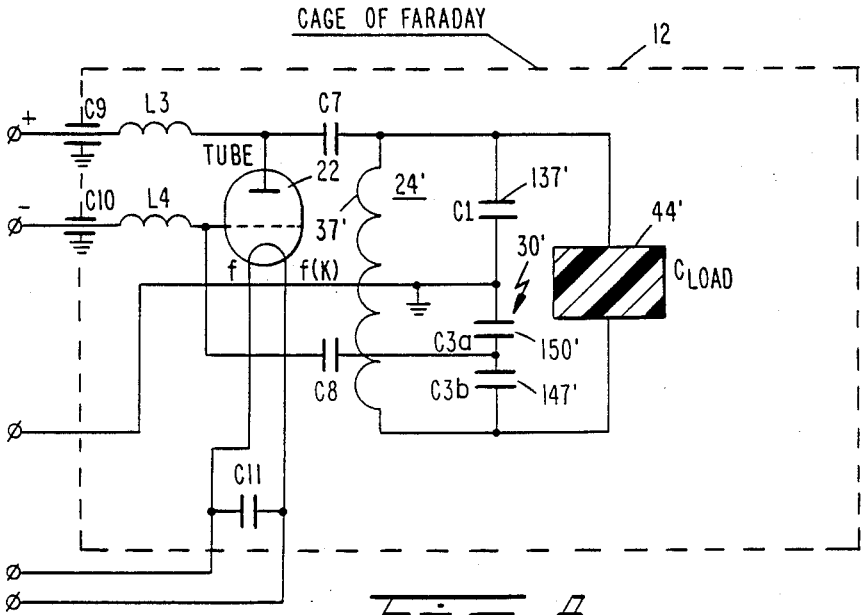
FIG. 8 shows an alternate embodiment of the invention including a modification of the circuit diagram of FIG. 1, using a single oscillating circuit to provide an open electric field for heating food between the plates of the load capacitor.

As will be illustrated in detail in conjunction with the embodiment shown in FIG. 8, a single oscillating circuit also increases the voltage swing between the plates of the load capacitor above the voltage swing across the power tube. Thus, the advantageous increase in spacing between the plates of the load capacitor may be attained by using one or two oscillating circuits.

Each of the oscillating circuits of FIG. 1 includes an inductor and a pair of capacitors. A junction point 28, between the capacitors of each oscillating circuit, is commonly connected to ground together with a cathode connection of the tube 22. A control voltage for a grid 29 of tube 22 provides a feedback connection between oscillating circuit 24 and the grid 29. As shown in FIG. 1, the feedback control voltage is obtained from a capacitive voltage divider 30 within the cooking cavity. The feedback control voltage is fed back from the voltage divider to grid 29 of tube 22. Accordingly, as will be appreciated by those skilled in the art, the triode tube 22 and the oscillating circuit 24 together operate to provide a feedback Colpitts type oscillator operating at a frequency determined by the product of the inductance and capacitance within oscillating circuit 24.

Although the capacitive voltage divider is shown as part of the electrode structure positioned within the heating cavity of the oven, it should be appreciated that such a divider may be formed by using ceramic capacitors placed outside the oven cavity.

The current provided from an anode 34 of tube 22 is provided both to oscillating circuit 24 and to oscillating circuit 26. Preferably, the natural oscillating frequencies (resonant frequencies) of the two oscillating circuits are substantially the same. Moreover, for reasons which will become clear, there is provided a phase establishing connection in order to maintain a predetermined phase difference between corresponding points of the two oscillating circuits.

The structure used to establish the desired phase relationship is illustrated by a connector 36 which connects the upper terminal of an inductor 37 of oscillating circuit 24 to the lower terminal of an inductor 39 of oscillating circuit 26. Thus, the two end points 38 and 40 of connector 36 are forced to have the same voltage thereat. Accordingly, the oscillating signals in oscillating circuits 24 and 26 have the same phase at points 38 and 40. Alternatively stated, since the oscillating signals at the two ends of an inductor in the illustrated LC oscillating circuit are 180° out of phase with one another, the phase establishing connector 36 establishes a phase differential of 180° between the voltage at the point 42 and the voltage at the point 38.

It will thus be appreciated that the voltage swing between points 38 and 42 is equal to the peak-to-peak voltage swing across the inductor of either oscillating circuit 24 or 26. Advantageously, in view of the increased voltage swing provided therebetween, the present invention includes a load capacitor between points 38 and 42. The load capacitor, shown at 44, includes a pair of electrode plates connected to points 38 and 42 of the two separate oscillating circuits, and defines an area, within the cooking cavity of the oven, for placement of the foodstuff to be heated. Similarly, a second load capacitor 46 is established intermediate the oscillating circuits 24 and 26, at the opposite ends of the inductors thereof.

It will be appreciated that the voltage swing across capacitor 46 is equal to the voltage swing across capacitor 44. When the two oscillating circuits 24 and 26 generate signals having the same amplitude, the voltage swing across either capacitor is twice the peak-to-peak voltage swing of the oscillating signal in either of oscillating circuits 24 and 26. Further, the peak-to-peak voltage swing across the inductor of either circuit is twice the voltage swing across tube 22. Thus, the voltage swing across each of the load capacitors is twice the voltage swing across the anode and cathode of tube 22.

It will also be noted that the loops of the two oscillating circuits 24 and 26 are separated from one another by the load capacitors 44 and 46. Thus, the capacitance of the load capacitors is made less significant in determining the oscillating frequency for each of the two circuits. The frequency of oscillation is thus determined substantially independently of the dielectric characteristics of the foodstuff placed between the plates of capacitors 44 and 46.

Accordingly, the frequency of oscillation of the two circuits remains substantially constant, independently of presence or absence of the product being heated within load capacitors 44 and 46 between the two circuits and substantially independently of the dielectric characteristics of such a product.

Referring now to the remaining portions of the circuit diagram of FIG. 1, the DC high voltage supplied by rectifying bridge 20 is further filtered by filtering circuits generally shown at 48, including feed through capacitors and chokes, connected to both the anode 34 and grid 29 of tube 22. Negative DC grid bias is established on grid 29 by a biasing resistor 50. The grid current may be measured by an ammeter 52 for display on the front panel of the inventive oven. Similarly, an ammeter 54 is shown for measurement and display, as desired, of the anode current. A potentiometer 56 is provided for adjustment of the maximum anode current.

In operation, a coil winding of a relay 58 provides overload protection. When the voltage across the winding of relay 58 reaches the trip point therefor, a contact 60 thereof opens, thus removing power from the winding of a second relay 62. As described below, relay 62 controls switching of a contactor 64 which controls feeding of the power supply to the high voltage transformer 16.

Several additional bypass capacitors are shown in parallel with ammeters 52 and 54, as well as in parallel with potentiometer 56. These capacitors (unnumbered) provide a low impedance bypass path for high frequency signals, thus insuring that the ammeters display DC values, and that relay 58 responds to the average, rather than peak, current values.

The structure of FIG. 1 further includes a filament transformer 66. The filament transformer includes a plurality of secondary, or output windings. A first output winding 68 provides a 5.8 output voltage supplied to heat the cathode of tube 22. A second output winding 70 provides a 220 volt AC output voltage for the winding of a relay 72, which controls main contactor 64. The winding of relay 72 is in series with a contact 74 of relay 62 as well as with a fuse 76, to provide protection for the circuit. Thus, when an overload condition occurs, contact 60 of relay 58 disables relay 62. Deenergization of relay 62, in turn, opens contact 74 to disable relay 72 and, ultimately, to open contactor 64.

The remaining portion of the control circuit for the inventive oven is supplied power by a third output winding 78 of the filament transformer 66. The output of winding 78 is a 24 volt AC voltage, and is protected by a fuse 80.

As shown in the schematic diagram, upon closure of contact 74 relay winding 72 activates contactor 64 to turn on the oven. Relay winding 62, which controls contact 74, is in turn controlled by a plurality of contacts reflecting occurrences of a number of conditions. Upon operation of a main switch 82 a lamp indicator 84 is energized to provide a display indicating supply of power to filament transformer 66. A fuse 86 is provided to protect the filament voltage transformer as well as the cooling ventilator for the system.

In that regard, there is provided a ventilator motor 88 in parallel with the primary winding circuit for filament transformer 66. A thermal circuit breaker 90 is provided in series with the ventilator motor to provide appropriate protection therefor Further, a relay winding 92 is also provided in series with the circuit breaker and the ventilator motor. The contact controlled by relay winding 92 is shown at 94 and is in series with the winding of a further relay 96 used to control switching and activation of the high voltage transformer 16. One contact of relay 96 is shown at 98 and is in series with the primary winding of the filament transformer 66. Thus, upon thermal overload of the ventilator motor, relay 92 is deenergized, contact 94 opens to deenergize relay 96, and contact 98 opens thus disconnecting the filament transformer from the power source. By disconnecting the filament transformer, relay 72 is deenergized, thus opening contactor 64 and disconnecting the high voltage transformer 16 from the power supply.

On normal operation main switch 82 is closed to activate the filament transformer 66. With relay 96 energized, a second contact thereof, shown at 100, is closed. This contact is in series with fuse 80 and these two components, together, are in series with the remaining control circuit supplied by the third output winding 78. A further safety measure is provided in the form of a door switch contact 102 which is also in series with fuse 80 and contact 100. Thus, when the main switch 82 and the door switch 102 are closed and an overload condition does not exist on the ventilator, power is supplied to the various relays, switches and indicators connected to the third output winding of the filament transformer.

The following description illustrates how control of the heating function may be manually or automatically established.

In that regard, there is provided a manually operated, normally open, ON switch 104 and a manually operated, normally closed, OFF switch 106. Upon momentary activation of ON switch 104 and of a further manually operated switch 108, power is supplied to energize the winding of a latching relay 110, thus closing contact 112 thereof and permitting switch 108 to be opened again without loss of power to the winding of relay 110. Provision of power to relay winding 110 also energizes a lamp indicator 114 to indicate that the oven is under manual control At this time, a second contact of relay 110, labeled 116, is closed to energize relay winding 62, thus closing contact 74 thereof and energizing relay winding 72, to close main contactor 64 and energize the high voltage transformer 16. At the same time, energization of winding 72 also results in closure of a second contact thereof, labeled 118, permitting reopening of the momentary switch 104.

Accordingly, it will be appreciated that the sequence of switch closures hereinabove described results in manual operation of the oven.

Alternatively, instead of operating the manually operated momentary switch 108, a timer switch 120 may be activated. Thus, upon activation of main switch 82 and ON switch 104 to begin operation, power is supplied to relay winding 62 by movement of a contact arm 122 of timer switch 120 to its lower position, rather than by closure of contact 116 of relay winding 110. Without activation of relay winding 110 the lamp indicator 114 is not energized. However, when the contact arm 122 moves to its lower contact position to energize relay winding 62, contact 74 is closed thus energizing relay winding 72 and closing contactor 64 to supply power to transformer 16, initiating operation of the oscillating circuits. As previously described, contact 118 will also be closed at this time, thus permitting switch 104 to be deactivated.

When the timer switch 120 times out, contact arm 122 moves back to the upper position thereof illustrated in FIG. 1. In this configuration, relay winding 62 is deenergized, thus opening contact 74 to deenergize relay winding 72, opening contactor 64 and disconnecting the primary winding of transformer 16 from the three-phase power supply.

At any time, whether in manual or timed operation, normally closed OFF switch 106 may be manually operated to remove power from the winding of relay 62. Thus, contact 74 is caused to open, deenergizing relay 72 and opening contactor 64, to disconnect the primary winding of transformer 16 from the power source and turning off the oscillating circuit.

Figure 2:
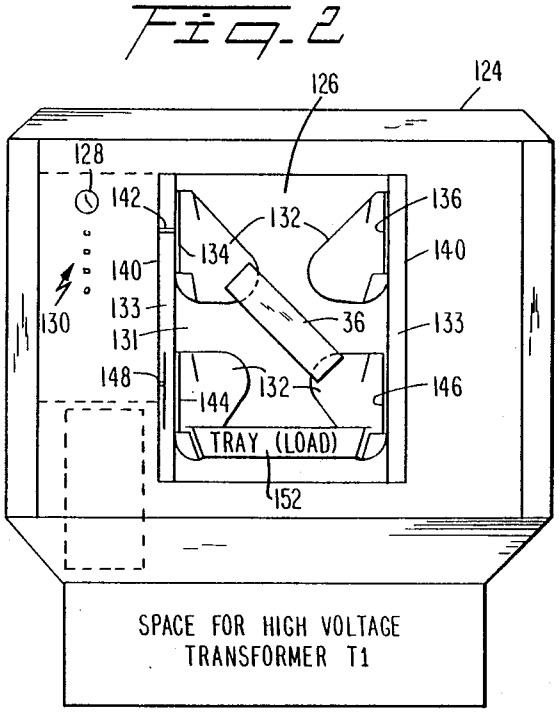
FIG. 2 is a front view of a structure embodying the invention showing the plural levels and sub-levels for heating food, formed by the capacitor plates thereof.

It should accordingly be appreciated that the control circuit illustrated in FIG. 1 provides either manual or timed operation of the oscillating circuits, and thus of the inventive oven. Although manually operated switches and relays are illustrated, it should be understood that various solid state circuits, switching devices, flip flops or the like may be used instead. Similarly, the functions hereinabove described may be carried out by a programmed computer in response to activation of various input keys of a keyboard or other input switches, or by other semiconductor circuits similarly responding to operation of input keys or switches. Referring now to FIG. 2, there is shown a structure incorporating the various circuits, electrodes, and controls hereinabove described with reference to FIG. 1. More particularly, there is shown a front view of a housing 124 and a heating cavity 126. On a front panel of the housing, a clock display 128 shows time-of-day or the heating time associated with timer switch 120. A number of contact switches 130 are provided for operator use, and provide the various switching and control functions hereinabove described.

As is apparent from FIG. 2, the electrode plates of the load capacitors are mounted by means of respective flat mounting portions 132 thereof to an insulated back wall 131 of the cavity. The capacitor plates further include portions mounted to the insulated sidewalls 133 of cavity 126. Plates 134 and 136, which form the electrodes of load capacitor 44, also form the upper plates of fixed capacitors 137 and 139, shown in FIG. 1, which form the oscillating circuits 24 and 26 with respective inductors 37 and 39. The lower plates of capacitors 137 and 139 are commonly grounded at point 28, as shown in FIG. 1. Accordingly, a grounded portion of housing 124, shown at 140, forms the common ground point 28, as well as the lower capacitor electrode plates for capacitors 137 and 139. Portion 140 may be electrically connected to the housing 124.

However, as seen in FIG. 1, electrode plate 134 (circuit point 38) is required to be connected (via a blocking capacitor) to the anode 34 of tube 22. Accordingly, a connector 142 is shown in FIG. 2 for providing the required connection.

The electrode plates of load capacitor 46 are shown at 144 and 146. These electrodes, similarly to electrodes 134 and 136, form bottom capacitor plates of capacitors 147 and 149, in oscillating circuits 24 and 26, respectively. Since capacitor 149 is formed between electrode plate 146 and ground, housing portion 140 also forms the upper plate of capacitor 149 of FIG. 1. Moreover, since the upper plate of capacitor 147 is required to be connected, via a blocking capacitor, to grid 29 of tube 22, there is shown yet another connector 148 to provide the required connection. Finally, to provide the capacitive voltage divider 30 of FIG. 1, connector 148 is embedded in the insulated sidewall 135 of cavity 126, to provide both the upper plate of capacitor 147 and the bottom plate of capacitor 150 of FIG. 1.

As will be appreciated from the foregoing description, the insulated walls 135 of the cavity form the dielectric for capacitors 137, 139, 147, 149 and 150. However, it is possible that other dielectrics may be used, separate and apart from the insulated walls 135 of the cavity. For example, individual dielectric components may be used with each capacitor. As seen in FIG. 1, connector 36 connects circuit points 38 (electrode plate 134) and 40 (electrode plate 146) in order to establish the appropriate phase relationship between the voltages across the load capacitors.

As shown in FIG. 2, the inventive structure provides two sets of electrodes, for two load capacitors at two stacked heating levels. Moreover, each of the electrode plates includes a pair of sublevels, defined by the positioning and shaping thereof. This aspect of the invention will be appreciated upon reference to FIG. 3, which shows a sectional view of an enlarged portion of the arrangement in FIG. 2.

Figure 3:
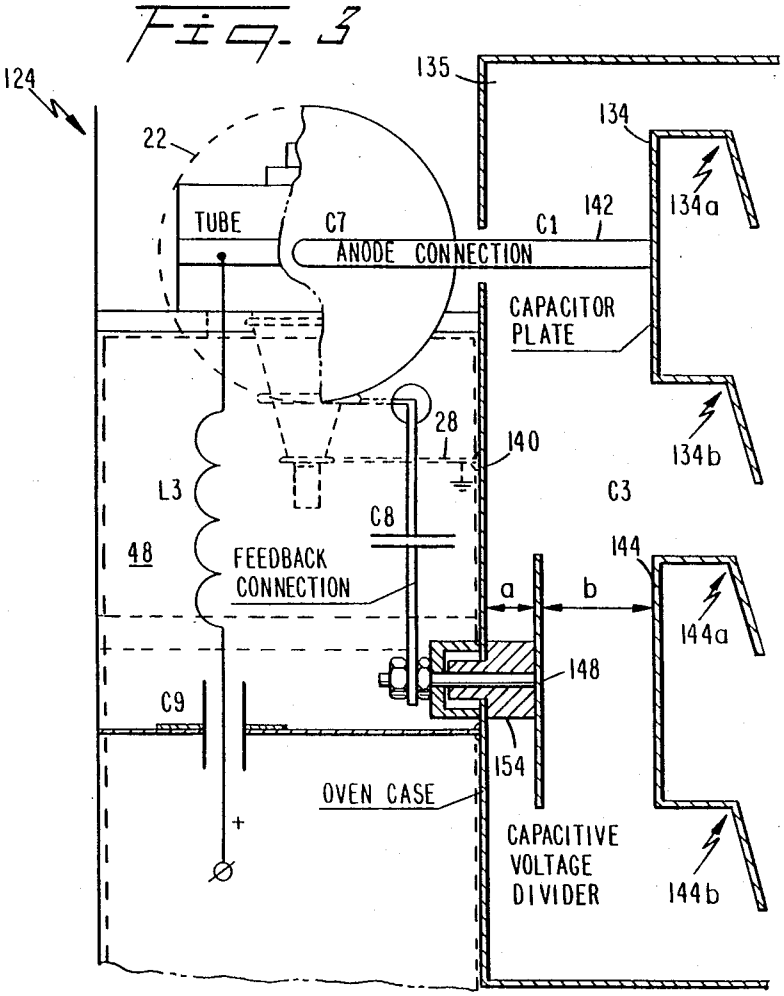
FIG. 3 is a sectional view showing an enlarged detail of the electrode structure shown in FIG. 2.

As seen in FIG. 3, electrode plates 134*f* and 144 each have upper and lower elements, 134*a*, 134*b* and 144*a* and 144*b*, respectively. Each element has horizontal and inclined portions. These portions are shaped to accommodate a lipped tray 152, shown in FIG. 2. As seen in FIG. 2, such a tray may have an upper horizontal flange, or lip, and sloping sides. By shaping the electrode plates as shown in FIG. 3, the tray may rest directly on the electrodes or may otherwise be accommodated thereby.

FIG. 3 further shows connector 142 as providing the anode connection for circuit point 38 in FIG. 1, through a blocking capacitor to the anode of tube 22. Similarly, connector 148 and the extension thereof are shown as being embedded within the dielectric sidewall 135. Of course, the extension of connector 148 may be in the form of a flat element attached thereto, to form the appropriate capacitor 147 denoted by arrow "b" in FIG. 3. A teflon grommet 154 is used to mount connector 148 to the conductive, grounded, portion 140 of housing 124 in an insulated manner. Thus, the flat portion of connector 148, by being separated from grounded portion 140 by a dielectric portion 135, forms capacitor 150 therewith, and is denoted by arrow "a" in the figure.

The illustrated structure accordingly provides the capacitive voltage divider 30 previously described. As has earlier been mentioned, however, the capacitive voltage divider may be constructed by connecting in series a pair of ceramic capacitors, for example, between electrode plate 144 and ground, and by connecting the point intermediate the two capacitors to grid 29.

The remaining portions of the control circuit, the transformers, ventilators, contact switches and relays of FIG. 1 are enclosed within housing 124.

Figure 4A:
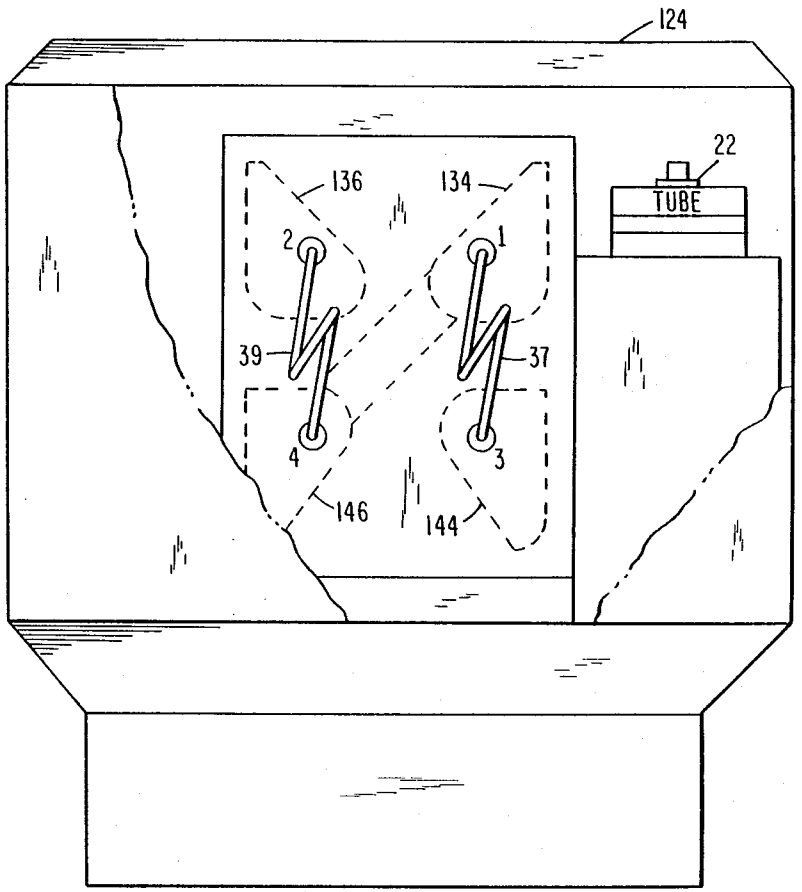
FIG. 4*a* is a rear view of the structure of FIG. 2, showing the inductors of the two oscillating circuits

In FIG. 4*a* there is shown a rear view of housing 124, broken away to illustrate the arrangement of the load capacitors with inductors 37 and 39. Particularly, it is noted that inductor 37 connects electrode plate 134 of load capacitor 44 to electrode plate 144 of load capacitor 46. Inductor 39 connects electrode plate 136 of load capacitor 44 to electrode plate 146 of load capacitor 46. The inductors are positioned externally of cavity 126, to increase the amount of space available for heating of foodstuff. The inductors may be connected to the flat mounting portions 132 of each of the electrode plates by passage of a conductor therebetween, via teflon grommets of the type previously described with reference to FIG. 3.

Figure 4B:
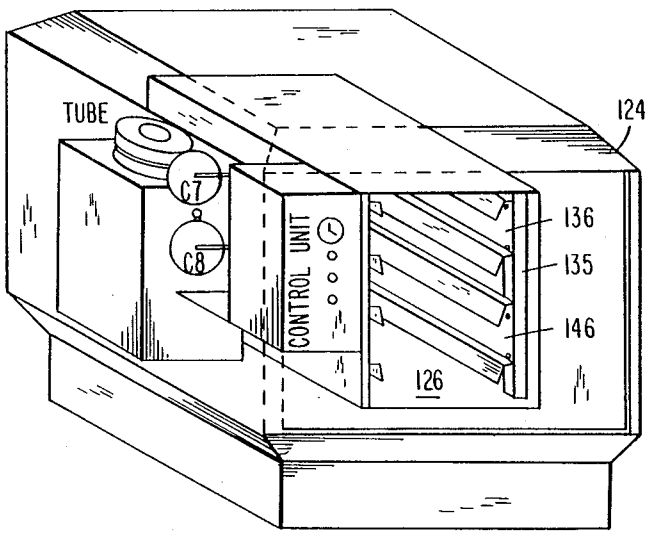
FIG. 4*b* is a perspective view of the inventive oven, including the electrode structure shown in FIG. 3.
Figure 4B:
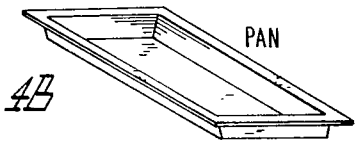

In FIG. 4*b* the inventive structure is shown in perspective. Thus, electrode plates 136 and 146 are seen to be mounted on insulated sidewall 135 of the cavity, providing four stacked sub-levels for heating foodstuff. The sub-levels are arranged as two sets of sub-levels, each set including a separate set of electrodes therefor.

Figures 5, 6:
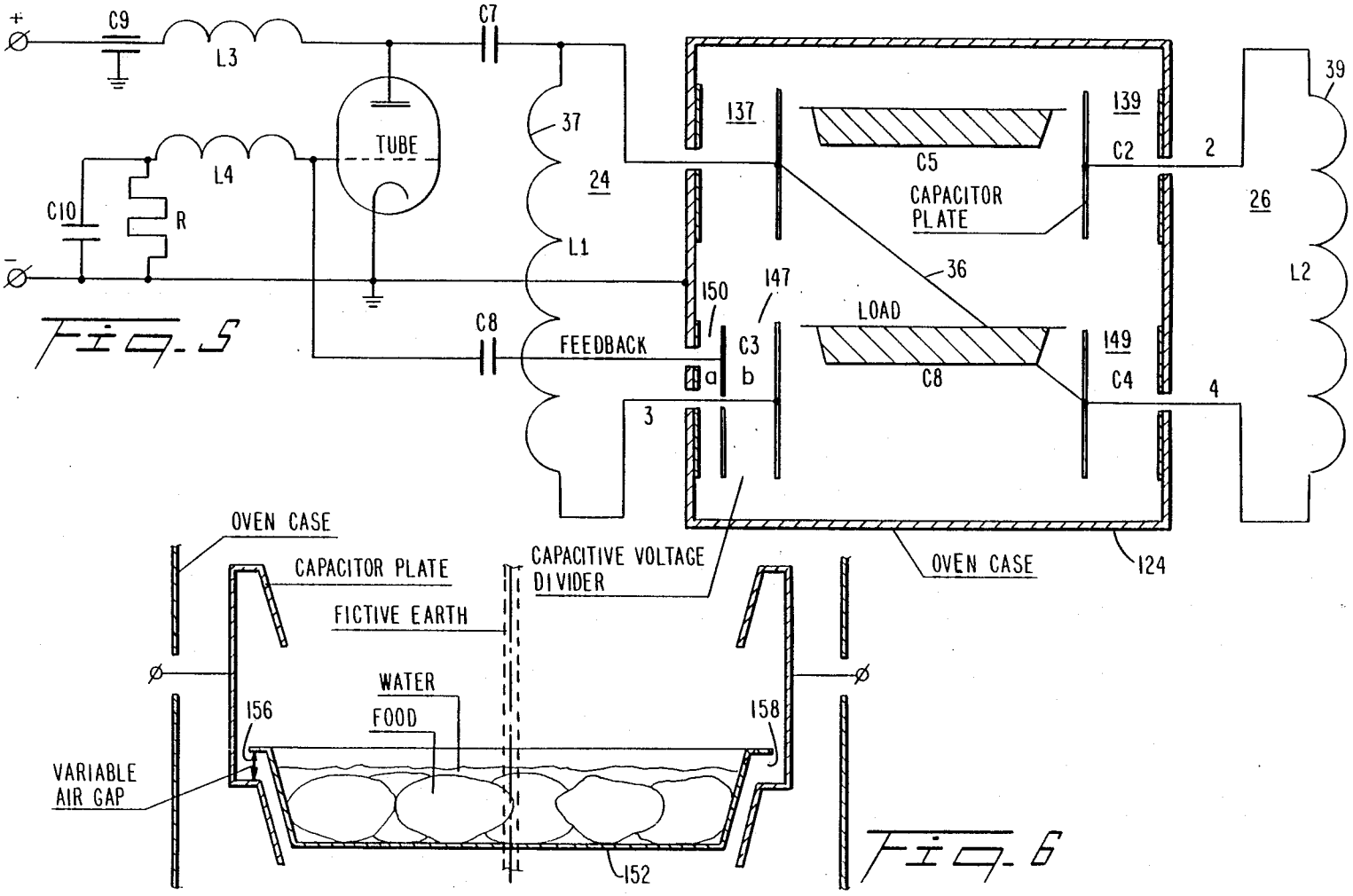
FIG. 5 shows a multi-level cooking arrangement for foodstuff in the inventive oven and illustrates a schematic arrangement of capacitor plates within the cooking cavity in accordance with the circuit diagram of FIG. 1.
FIG. 6 shows an arrangement of a tray, supported by the electrode structure of FIG. 3, and a variable air gap capacitance used for power control for the inventive oven.

In the arrangement of FIG. 5 there is shown the basic electrical interconnection of the inventive circuit, including two oscillating circuits 24 and 26, connector 36, and a pair of electrode sets, a separate electrode set being provided for each stacking level of the foodstuff. It is to be understood that, although two oscillating circuits are shown, any number of oscillating circuits may be used in accordance with the invention. In such arrangements with different numbers of circuits, the phase relationships for the oscillating signals in the circuits might be changed. For example, in a structure utilizing three oscillating circuits, the phase establishing devices used for various pairs of circuits may be selected to provide 120° phase shifts therebetween, thus permitting six separate sets of electrode plates to be established for six different cooking levels.

In the arrangement illustrated in FIG. 5, the grounded electrode plates of capacitors 137, 139, 149 and 150 are seen to be separate conductive plates, each grounded to the housing 124. Separate trays are shown in a vertically stacked arrangement, with trays at each separate level being located within a separately generated electric field. While the illustrated structure connects the separate capacitors of the different levels to the same power tube and to the same oscillating circuits, it should be appreciated that separate oscillating circuits may be provided for each level, whether connected to the same or different power tubes. For each such arrangement, separate power controls may be provided for each of the levels.

Figure 7:
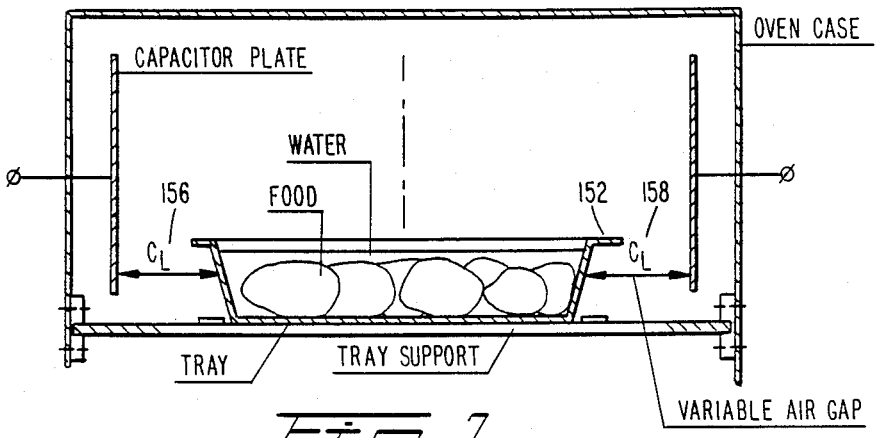
FIG. 7 shows an alternate arrangement for the variable air gap capacitor control of FIG. 6.

Referring now to FIGS. 6 and 7, there is shown a manner of controlling the dielectric losses generated within the foodstuff. More particularly, in the arrangement of FIG. 6 there are provided variable air gap capacitors between each of the electrode plates and the food tray. By providing an adjustable positioning device for variably spacing the tray 152 from the electrode plate, the air gap capacitance therebetween may be varied. In FIG. 7, the tray is supported by a separate support plate 160. Similarly to FIG. 6, however, variable gaps are provided between the tray and the capacitor plates. In the structure of FIG. 7, the position of support plate 160 may be adjusted, either vertically or horizontally, in order to effect the desired variation in air gap capacitances.

The following illustrates the power control which may be effected by such an arrangement. Referring to the combined air gap capacitance of capacitors 156 and 158 as Ca, and referring to the capacitance of the food as Cf, the total load capacitance is given by $$CL=(Ca+CF)/(Ca+Cf).$$

Thus, since the air gap and food capacitors are in series, the voltage Vf developed across the food capacitor Cf is given by $$Vf=V*Ca/(Ca+Cf),$$

where V is the voltage drop across the entire combination, i.e., the voltage between the capacitor plates.

It is accordingly seen that, for a given food having a given dielectric constant, and thus a given food capacitance Cf, the voltage developed across the foodstuff is changed by changing the air gap distance and hence the air gap capacitance Ca. More particularly, since the power dissipated within the foodstuff is proportional to the product of Cf and the square of the voltage developed thereacross, the foregoing analysis confirms that control of the power transferred to the foodstuff may be had by a variable air gap capacitor in series therewith.

Moreover, by providing an air gap capacitance which is significantly greater than the foodstuff capacitance, i.e., by making $Ca>>Cf$, the voltage developed across the foodstuff will be substantially invariant with the dielectric constant of the foodstuff. At any rate, however, any variation in power dissipation within the foodstuff will result in variation of the relative distribution of power between the air gap control capacitor and the foodstuff capacitance, while maintaining invariant the total voltage across the load capacitor. Thus, the power dissipated by the power tube 22, and the rating thereof, may be fixed substantially independently of the characteristics of the product being heated by the oven of the present invention.

Of course, while the foregoing description refers to an "air gap" capacitor, it should be understood that other dielectric materials may be used in such a power control device and that the power dissipation in the foodstuff is more generally controlled by providing a variable capacitance in series with the food capacitance.

Referring now to FIG. 8, there is shown an alternate embodiment of the invention, wherein only a single oscillating circuit is used. However, with a circuit of the type illustrated there is advantageously provided a voltage across the load capacitance which exceeds the voltage across the power tube, and which thus permits the heating of larger quantities of food thereby.

More particularly, the circuit of FIG. 8 is substantially identical to the high frequency generating portion of the circuit of FIG. 1, with the exception of the absence of oscillating circuit 26, connector 36, and second load capacitor 46. Thus, the circuit illustrated in FIG. 8 provides a single load capacitance 44', driven by a single oscillating circuit 24', at a frequency determined by the inductance of inductor 37' and the capacitance of capacitor 137' and voltage divider 30'. Let it be assumed that the combined capacitance of capacitors 147' and 150', forming capacitive divider 30', is equal to the capacitance of capacitor 137'. Thus, the voltage drops across capacitors 147' and 150' are equal during a portion of the oscillating period when the tube current is zero. Accordingly, it will be appreciated by those skilled in the art that the maximum voltage drop across the inductor 37' will be twice the maximum voltage drop across the tube 22, with the two voltages oscillating sinusoidally at a frequency determined by the capacitance of the tank circuit and the inductance of inductor 37'.

Adding the load capacitance 44' to the circuit does not change the above relationship between the magnitude of the voltages developed across inductor 37' and tube 22. However, since the capacitance of the load capacitor is directly connected across the inductor, the oscillation frequency will be dependent thereon. Nonetheless, the parallel connection between load capacitor 44' and the series combination of capacitors 137' and 30' means that the capacitance of load capacitor 44' is added thereto. If the capacitances of capacitors 137', 150' and 147' are sufficiently large relative to 44', then the frequency of oscillation will remain stable and independent of the dielectric coefficient of the foodstuff being heated.

Figure 9A:
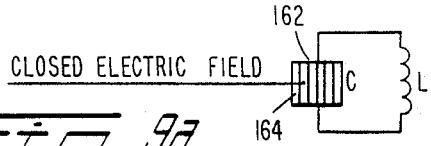
FIGS. 9*a* and 9*b* illustrate and define closed and open electric fields, respectively.
Figure 9B:
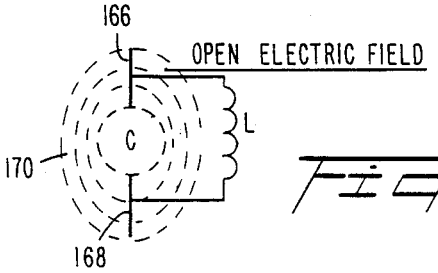

Referring now to FIGS. 9*a* and 9*b*, there are shown therein illustrations and definitions of closed and open electric fields. Particularly, FIG. 9*a* illustrates an arrangement wherein an electric field exists only between the plates of a capacitor 162. The electric field is represented by lines 164, which are confined to the area between the capacitor plates. Such a circuit does not radiate electromagnetic energy.

FIG. 9*b*, on the other hand, shows a different arrangement of components. Therein, the plates of the capacitor have been opened, as shown at 166 and 168. Such a circuit radiates an electromagnetic field, which is not confined to the area between the radiating surfaces 166 and 168. Accordingly, the field distribution represented by the lines 170 is defined as an open field.

Figure 10:
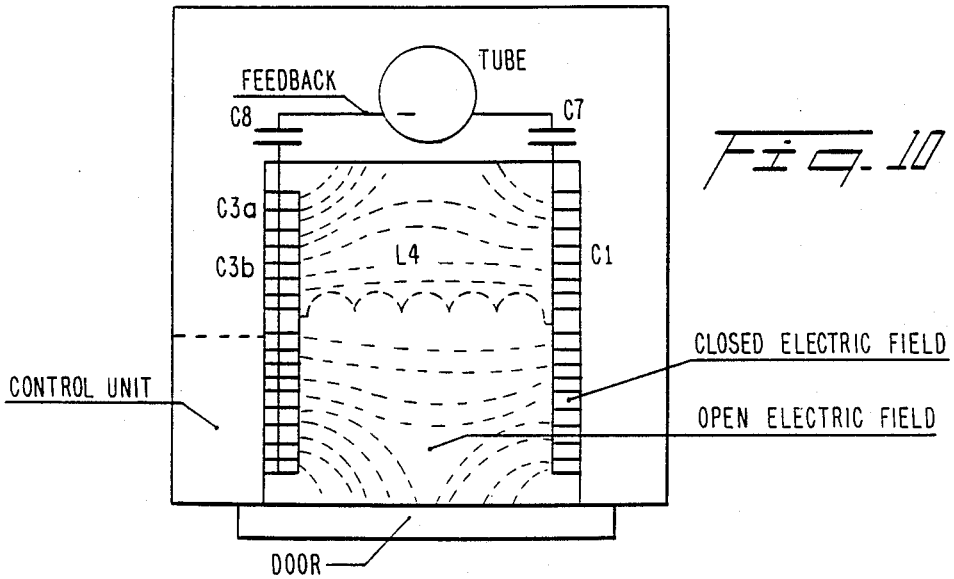
FIG. 10 the distribution of the open electric field produced by the embodiment of FIG. 8.

In FIG. 10 there is illustrated a top view of the distribution of the electric field generated by the single oscillating circuit embodiment of FIG. 8. As shown therein, a closed electric field exists between the plates of capacitors 137', 150' and 147', while an open field is generated between the bottom plate of capacitor 146' and the top plate of capacitor 137', i.e., within the load capacitor 44'. It is noted, however, that, although the distribution is nominally an open field distribution and some of the field lines terminate on the grounded portions of the housing, in fact the field lines simulate a closed electric field.

In the single oscillating circuit embodiment of FIG. 8, the dimensions of the structure of FIG. 10 are substantially the same as those for the similar structure used for the double oscillating circuit embodiment of FIG. 2.

However, the dimension of the plates of capacitors 137', 150' and 147' along the cavity wall are doubled, in order to double the plate area of the load capacitor, thus to maintain the same capacitance thereof in order to permit the same spacing between the plates of the load capacitor. That is, since only a single oscillating circuit is used, the voltage impressed across the single load capacitor is equal to the voltage of a load capacitor of the double oscillating circuit. In order to provide the same power dissipation in the foodstuff, the load capacitance is doubled. Thus, a disadvantage of the embodiment of FIG. 8 is the requirement for doubling the plate areas of the capacitors, as well as a change in the field distribution from a distribution for the two oscillating circuit embodiment, described below.

Nonetheless, although the single oscillating circuit embodiment thus requires some modification in dimensions, such a circuit enjoys a freedom from the requirement for selecting identical components in order to establish the same oscillating frequency for two oscillating circuits. Further, a possibility of improper loading of the oven by mismatched circuits is eliminated.

Figure 11:
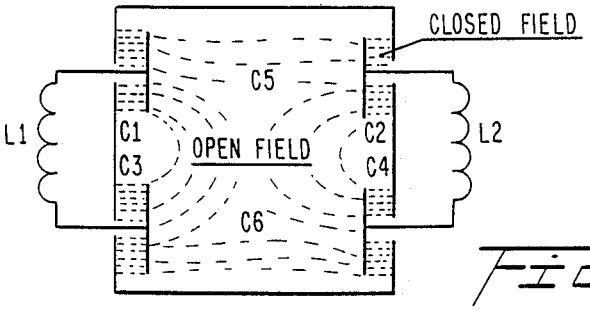
FIG. 11 shows the field distribution for the electric field produced by the embodiment of FIG. 2.

Referring to FIG. 11, the field distribution for the embodiment of two oscillating circuits is illustrated. As shown therein, similarly to the distribution of FIG. 10, there is provided a combination of a closed field between the plates of the circuit capacitors and an open field between the plates of the load capacitor. However, the field lines are seen primarily to be curvedly directed between the plates of capacitors along the same wall of the cavity.

The foregoing description of the preferred embodiment of the invention has been presented for purposes of illustration and description and is not intended to be exhaustive or to limit the invention to the precise forms disclosed, since many modifications and variations are possible in light of the above teaching. The embodiment was chosen and described in order best to explain the principles of the invention and its practical application, thereby to enable others skilled in the art best to utilize the invention in various embodiments and with various modifications as are suited to the particular use contemplated therefor. It is intended that the scope of the invention be defined by the claims appended hereto, when interpreted in accordance with full breadth to which they are legally and equitably entitled.

What is claimed:

1. In a high-frequency dielectric oven for cooking foodstuff, including a cavity for receiving the foodstuff when cooking, a high frequency oscillating circuit, including a power tube, having an operating voltage defined by a power supply voltage applied thereto, said power tube operating for generating a high frequency electric signal, and electrode means for introducing an electric field into the cavity to transfer power from the oscillating circuit to the foodstuff, the improvement comprising power increasing means for increasing the power transferred from the oscillating circuit to the foodstuff without substantially increasing the operating voltage of the tube and without requiring a shift of a phase or a frequency of operation thereof, thereby improving stability and controllability of power transferred to the foodstuff.

2. An improved high-frequency oven as recited in claim 1, wherein the foodstuff is positioned between plates of a capacitor in the oscillating circuit, said oscillating circuit including voltage doubling means for providing a voltage across the capacitor having a magnitude twice the magnitude of a voltage across the power tube, thereby enabling doubling of a distance between the plates of the capacitor without diminution of the field strength therebetween and increasing a volume of food heated between the capacitor plates.

3. An improved high-frequency oven as recited in claim 1, wherein said power increasing means comprises a plurality of oscillating circuits having substantially identical resonant frequencies, respective ones of said oscillating circuits connected to receive power from the power tube to establish respective oscillating signals therein, and phase setting means connected to said oscillating circuits for establishing a predetermined phase relationship between pairs of said oscillating signals.

4. An improved high-frequency oven as recited in claim 3, wherein said plurality of oscillating circuits comprises first and second oscillating circuits, wherein said electrode means comprises at least first and second electrodes respectively connected to each of said first and second oscillating circuits, said first and second electrodes located in said cavity for including said foodstuff therebetween.

5. An improved high-frequency oven as recited in claim 4 wherein said first and second electrodes are shaped for supporting a tray containing said foodstuff therein.

6. An improved high-frequency oven as recited in claim 5 wherein each of said electrodes includes a horizontal portion and a depending portion descending at a predetermined angle from said horizontal portion, thereby to provide support thereon for a tray having a horizontal lip and an angularly depending portion connecting the horizontal lip to a bottom portion of the tray.

7. An improved high-frequency oven as recited in claim 3 wherein said plurality of oscillating circuits comprises first and second oscillating circuits, each oscillating circuit having two electrodes, wherein said electrode means comprises at least first and second electrode pairs, each electrode pair located in said cavity for including said foodstuff therebetween, each electrode pair including first and second electrodes respectively connected to said first and second oscillating circuits.

8. An improved high-frequency oven as recited in claim 7 wherein said phase setting means comprises means for establishing a 180° phase shift between oscillating signals in the first and second oscillating circuits thereby doubling a peak value of an oscillating signal voltage applied across each of said electrode pairs relative to a peak value of an oscillating signal voltage applied thereacross by a single oscillating circuit.

9. An improved high-frequency oven as recited in claim 8 wherein said phase setting means comprises a connection between a first electrode of said first electrode pair and a second electrode of said second electrode pair, thereby establishing a voltage on a second electrode of said first electrode pair which is 180° out of phase with a voltage on the first electrode thereof, and further establishing a voltage on a first electrode of said second electrode pair which is 180° out of phase with a voltage on the second electrode thereof.

10. An improved high-frequency oven as recited in claim 9 wherein said first oscillating circuit is connected to said power tube and said second oscillating circuit is connected to said power tube by said connection between the first electrode of said first electrode pair and the second electrode of said second electrode pair.

11. An improved high-frequency oven as recited in claim 7 wherein each oscillating circuit includes an inductance and a capacitance, the capacitance comprising a pair of capacitors respectively formed between said two electrodes of said oscillating circuit and wall portions of the cavity.

12. An improved high-frequency oven as recited in claim 11 wherein said two electrodes of each oscillating circuit are oriented to radiate an open electric field therebetween, said electrode pairs of said electrode means forming a pair of interconnecting capacitors between said electrodes of said first and second oscillating circuits and having a dielectric including the foodstuff therebetween, thereby providing radiation of an open electric field between said first and second electrodes of each of said pair of interconnecting capacitors, said open electric field having a power intensity determined by a dielectric characteristic of the foodstuff while the power tube operates at a substantially constant power level, and substantially isolating a frequency of oscillation of said oscillating circuits from effects of a dielectric characteristics of the foodstuff.

13. An improved high-frequency oven as recited in claim 12, further comprising a variable air capacitor means between said electrodes of said interconnecting capacitors and the foodstuff therebetween for controlling power applied to the foodstuff within said interconnecting capacitors.

14. An improved high-frequency oven as recited in claim 12, wherein said phase setting means comprises means for establishing a 180° phase shift between oscillating signals in the first and second oscillating circuits, thereby establishing a virtual ground plane between said first and second electrodes of each of said interconnecting capacitors having said foodstuff therebetween.

15. An improved high-frequency oven as recited in claim 11, further comprising a feedback electrode for providing a control voltage to a grid of the power tube, said feedback electrode disposed between a predetermined electrode of one of said oscillating circuits and one of said wall portions of said cavity forming a capacitive voltage divider for voltage impressed on said predetermined electrode.

16. An improved high-frequency oven as recited in claim 11, further comprising a feedback electrode for providing a control voltage to a grid of the power tube, and a capacitive voltage divider for voltage impressed between a predetermined electrode of one of said oscillating circuits and one of said wall portions of said cavity, including a pair of ceramic capacitors disposed externally of said cavity, said feedback electrode connected between said capacitive voltage divider and the grid of the power tube.

17. An improved high-frequency oven as recited in claim 1, wherein said high frequency oscillating circuit includes a load circuit having the foodstuff as a load thereon, and comprising a signal path between said load circuit and said power tube for establishing a single resonant frequency for said power tube and said load circuit.

18. An improved high-frequency oven as recited in claim 17 wherein said signal path comprises a feedback path between said load circuit and said power tube for establishing said single resonant frequency for said power tube in combination with said load circuit.

19. An improved high-frequency oven as recited in claim 18, further comprising a variable capacitor in said load circuit for controlling power transfer to said foodstuff.

20. An improved high-frequency oven as recited in claim 19 wherein said variable capacitor comprises a variable air-gap capacitor.

21. In a high-frequency dielectric oven for cooking foodstuff, including a cavity for receiving the foodstuff when cooking, a high frequency oscillating circuit, including a power tube, for generating a high frequency electric signal and electrode means for introducing an electric field into the cavity to transfer power from the oscillating circuit to the foodstuff, the improvement comprising:

a multi-level structure for supporting a plurality of vertical levels of foodstuffs within the cavity, said multi-level structure including a plurality of separate pairs of electrodes forming a separate load capacitor for each vertical level in the cavity, each separate load capacitor including separate foodstuff between electrode plates thereof, and phase setting means connected to establish a predetermined phase relationship between voltages on said separate load capacitors.

22. In a high-frequency dielectric oven for cooking foodstuff, including a cavity for receiving the foodstuff when cooking, a high frequency oscillating circuit, including a power tube, for generating a high frequency electric signal and electrode means for introducing an electric field into the cavity to transfer power from the oscillating circuit to the foodstuff, the improvement comprising:

a multi-level structure for supporting a plurality of vertical levels of foodstuffs within the cavity, said multi-level structure including a plurality of separate pairs of electrodes forming a separate load capacitor for each vertical level in the cavity, each separate load capacitor including separate foodstuff between electrode plates thereof, and means for connecting each separate pair of electrodes to a network for generating a separate oscillating signal and for radiating separate high-frequency electric fields into the separate vertical levels having said separate load capacitors.

23. An improved high-frequency oven as recited in claim 22 including control means for controlling the power radiated into the vertical levels, thereby controlling dielectric losses in the foodstuff and the temperature generated therein.

24. In a high-frequency dielectric oven for cooking foodstuff, including a cavity for receiving the foodstuff when cooking, a high frequency oscillating circuit, including a power tube, for generating a high frequency electric signal and electrode means for introducing an electric field into the cavity to transfer power from the oscillating circuit to the foodstuff, the improvement comprising:

a multi-level structure for supporting a plurality of vertical levels of foodstuffs within the cavity, said multi-level structure including a plurality of separate pairs of electrodes forming a separate load capacitor for each vertical level in the cavity, each separate load capacitor including separate foodstuff between electrode plates thereof, further comprising a plurality of oscillating circuits having substantially identical resonant frequencies, each oscillating circuit having at least first and second electrodes arranged to radiate an open electric field therebetween, each of said first and second electrodes forming one plate of a capacitor, the other plate of each said capacitor formed as a portion of a wall of the cavity, each of said load capacitors comprising plate portions formed by electrodes of different ones of said oscillating circuits and having an open electric field radiated therebetween.

25. An improved high-frequency oven as recited in claim 24 further comprising control means for controlling power radiated into foodstuff within said load capacitors.

26. An improved high-frequency oven as recited in claim 25 wherein said control means comprises variable air-gap capacitor means substantially in series with said foodstuff.

27. An improved high-frequency oven as recited in claim 24 wherein each oscillating circuit has an inductance means for determining, together with said capacitors formed by said first and second electrodes, a resonant frequency for said oscillating circuit, substantially independently of a capacitance of said load capacitors.

28. An improved high-frequency oven as recited in claim 24 further comprising means for establishing a 180° phase shift between oscillating signals in first and second oscillating circuits having electrodes forming said load capacitors, thereby doubling a peak value of an oscillating signal voltage applied across each of said load capacitors relative to a peak value of an oscillating signal voltage applied thereacross by a single oscillating circuit and thereby further establishing a virtual ground plane between said electrodes of each of said load capacitors having said foodstuff therebetween.

29. An improved high-frequency oven as recited in claim 24 wherein said plate portions of each of said separate load capacitors comprises support means for supporting trays containing said foodstuffs.

30. An improved high-frequency oven as recited in claim 29 wherein said support means comprises first and second vertically displaced support structures for each of said plate portions, thereby providing for each of said separate load capacitors a pair of vertically displaced cooking levels, thereby subdividing said multi-level structure to a plurality of levels each having a separate load capacitor and each having a plurality of sublevels formed between the plates of said separate load capacitor thereof.

* * * * *